United States Patent [19]

Werner

[11] Patent Number: 4,682,483

[45] Date of Patent: Jul. 28, 1987

[54] PERMUTATION LOCK

[75] Inventor: Hans U. Werner, Solingen, Fed. Rep. of Germany

[73] Assignee: S. Franzen Sohne GmbH & Co. KG, Solingen, Fed. Rep. of Germany

[21] Appl. No.: 905,234

[22] Filed: Sep. 9, 1986

[30] Foreign Application Priority Data

Nov. 15, 1985 Fed. Rep. of Germany .. P3540533.3

[51] Int. Cl.[4] ..... E05B 37/02

[52] U.S. Cl. ..... 70/312; 70/315; 70/286; 70/69; 70/74; 70/443; 70/444

[58] Field of Search ..... 70/69–72, 70/74, 75, 77, 312, 314, 315, 304, 286–288, 442–444

[56] References Cited

U.S. PATENT DOCUMENTS

| | | | |
|---|---|---|---|
| 860,550 | 7/1907 | Leighton | 70/443 |
| 3,115,765 | 12/1963 | Fengler | 70/288 X |
| 3,677,042 | 7/1972 | Atkinson | 70/312 X |
| 3,808,852 | 5/1974 | Mohrhauser et al. | 70/314 X |
| 4,100,775 | 7/1978 | Bako | 70/70 X |
| 4,350,030 | 9/1982 | Bromley | 70/70 |
| 4,366,685 | 1/1983 | Remington | 70/70 |
| 4,420,953 | 12/1983 | Remington | 70/74 |
| 4,520,641 | 6/1985 | Bako | 70/314 X |

FOREIGN PATENT DOCUMENTS

| | | | |
|---|---|---|---|
| 2146694 | 4/1985 | United Kingdom | 70/69 |

*Primary Examiner*—Robert L. Wolfe
*Assistant Examiner*—Suzanne L. Dino
*Attorney, Agent, or Firm*—Burns, Doane, Swecker & Mathis

[57] ABSTRACT

A permutation lock is mountable on one section of a case and is adapted to secure a hasp carried by another portion of the case. The lock comprises a main housing in which a permutation setting mechanism is disposed. That mechanism includes a movable spring-biased locking element which is movable between a locking position and an unlocking position. A movable spring-biased locking bolt is arranged for rotation between a locking position for securing the hasp and an unlocking position for releasing the hasp. When the locking element is in its locking position, it prevents the bolt from moving from its locking position to its unlocking position. The bolt is mounted in an ancillary housing which is connected to the main housing at a rear end thereof, such that a wall separates the bolt from the locking element. The locking element includes a projection which is arranged to project through an opening in the wall when the locking element is in its locking position, in order to prevent rotation of the bolt from its locking position to its unlocking position. The ancillary housing is attached to the main housing only in cases where the depth of the main housing is insufficient to enable the projection to directly reach the hasp.

11 Claims, 5 Drawing Figures

PERMUTATION LOCK

BACKGROUND AND OBJECTS OF THE INVENTION

The invention relates to a permutation lock of the type comprising a housing which is insertable into an opening in a part of a case or the like.

In such a lock the housing typically includes a front plate containing a plurality of windows through which project setting elements of a permutation lock. The setting elements are connected to locking sleeves having collars which include interruptions such as flats. The interruptions are sensed by a spring-loaded locking element, whereby in case of a correctly set secret code, all of the interruptions are facing and contacted by the locking element. In that position the locking element releases a separate spring-loaded pivoted bolt which releases and raises the hasp previously retained by the bolt, to enable the lid of the case to be opened.

In a combination lock according to Walters U.S. Pat. No. 3,436,938 a pivoted bolt inserted in the locking path between the locking element and the hasp is located in the lock housing. The hasp projects into the locking position through a slot in the relatively narrow longitudinal side wall of the housing. Even small dimensional inaccuracies, for example, those merely due to manufacturing tolerances, raise alignment and registration problems wherein the hasp may not be able to enter the slot. A precise, specially adapted configuration of the parts of the suitcase is thus required. Furthermore, in situations wherein the lock housing is inserted into a hole in the case which is so deep that the housing is not immersed sufficiently through the hole to enable the slot to be exposed, a lock of the above described type cannot be employed.

It is an object of the invention to develop a permutation lock of the afore-mentioned generic type that may be produced simpler and has favorable alignment and registration features, so that it may be used for example in spite of different wall thicknesses by simple refitting, and eliminates the need to develop a special type of lock.

SUMMARY OF THE INVENTION

These objects are achieved in accordance with the present invention which involves the provision of an ancillary housing connected to the main housing at a rear end thereof opposite the front plate. The bolt and its biasing spring are mounted in the ancillary housing. Either the main or ancillary housing includes a wall between the locking bolt and the locking element. The locking element includes a lock portion arranged to project through a region not covered by the wall, when the locking element is in its locking position, in order to prevent rotation of the bolt from its locking position to its unlocking position.

As the result of such a configuration a more versatile permutation lock is provided. While retaining the basic lock configuration, different locks may be assembled for different wall thickness of cases by simply attaching the ancillary housing. Advantageously, by means of the external arrangement of the pivoted bolt, the range of the point of attack between the hasp and the pivoted bolt may be favorably enlarged. The pivoted bolt, located in the ancillary housing, extends beyond the inside wall of the case. The pivoted bolt and its spring are optimally protected. Since the locking element protrudes through the housing rear, there is no need to enlarge the opening in the wall of the suitcase. If the wall thickness is less than the depth of the lock housing, the ancillary housing and bolt can be omitted, whereby the locking element may, as usual, cooperate directly with the hasp. Otherwise, if the ancillary housing is attached, the locking element blocks the pivoted bolt within the ancillary housing.

In order to cover the largest possible depth range in a locking manner, the length of the hooking head of the pivoted bolt is made to correspond to the inner height of the ancillary housing. The latter preferably corresponds approximately to one-half of the depth of insertion of the lock housing. In order to assure a pivoting motion of the pivoted bolt as free of friction as possible, the lateral flanks of the pivoted bolt in the area of its hub are resting against the outer surface of the housing bottom and the cover of the ancillary housing opposing it. The expanded, hook-like projections of the pivoted bolt itself, therefore, are not sliding against the housing and bottom surfaces involved. A simple but durable alignment of the ancillary housing may be obtained by connecting it by means of flexible tabs with the bottom of the housing which tabs are releasable if necessary. The main housing itself contains the tabreceiving slots, which can be provided readily in production.

It is advantageous further to have the locking element engage a rear flank of the hooking head of the pivoted bolt, which rear flank is located adjacent to the opening in the housing wall. It is also of advantage further to bearingly support the pivoted bolt at an end of the ancillary housing disposed opposite the opening and to arrange the pivoting planes of the pivoted bolt and the locking element perpendicularly to each other, with the locking element moving into its locking position toward the axis of the pivoted bolt. In this manner the design features of the permutation lock setting mechanisms are utilized in the most favorable manner, since the locking bolt is supported on the opposite side of the wall and the locking element may bear against the wall in case of an over loading of the housing. The lock sleeves, etc., thus remain free of stress.

THE DRAWING

The objects of the invention will become more apparent from a preferred embodiment of the invention set forth below with reference to the drawing. In the drawing.

DETAILED DESCRIPTION OF A PREFERRED EMBODIMENT OF THE INVENTION

Figure 2:
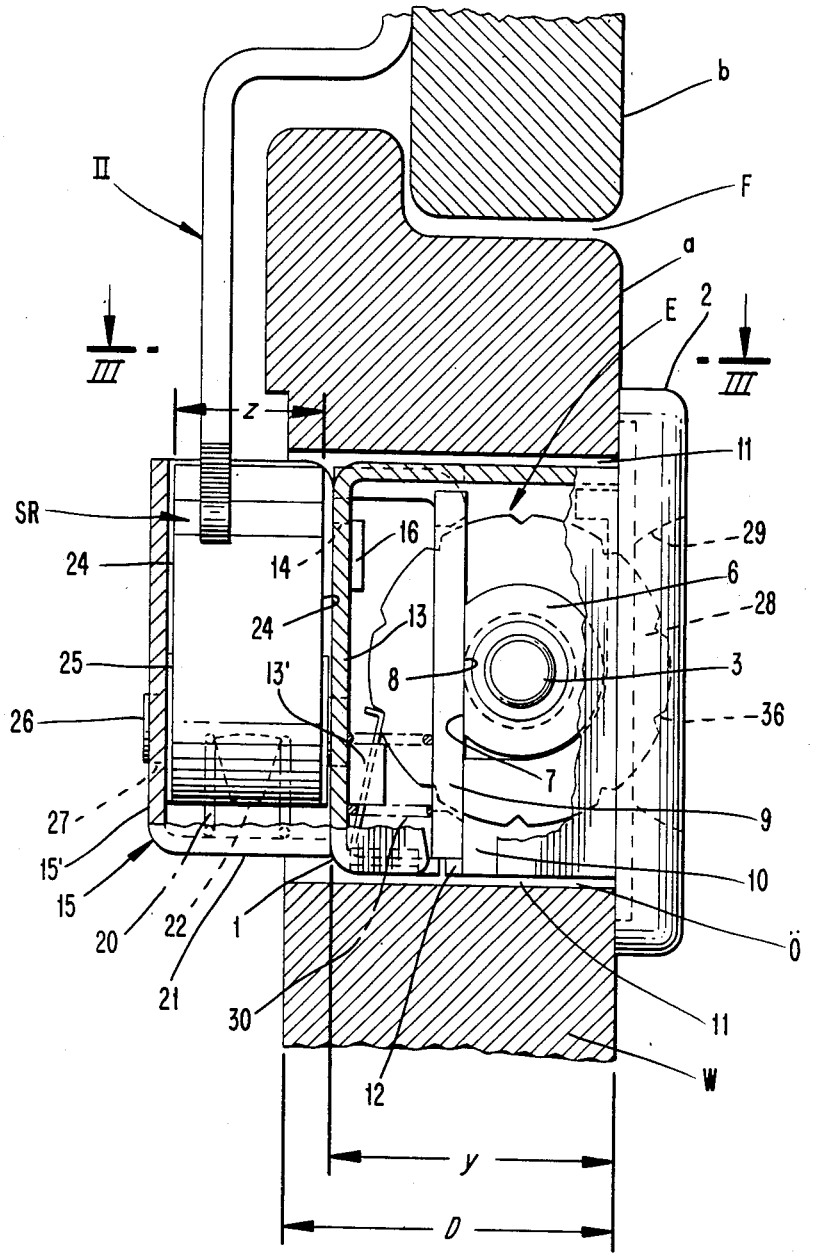
FIG. 2 depicts the same lock in cross-section.
Figure 3:
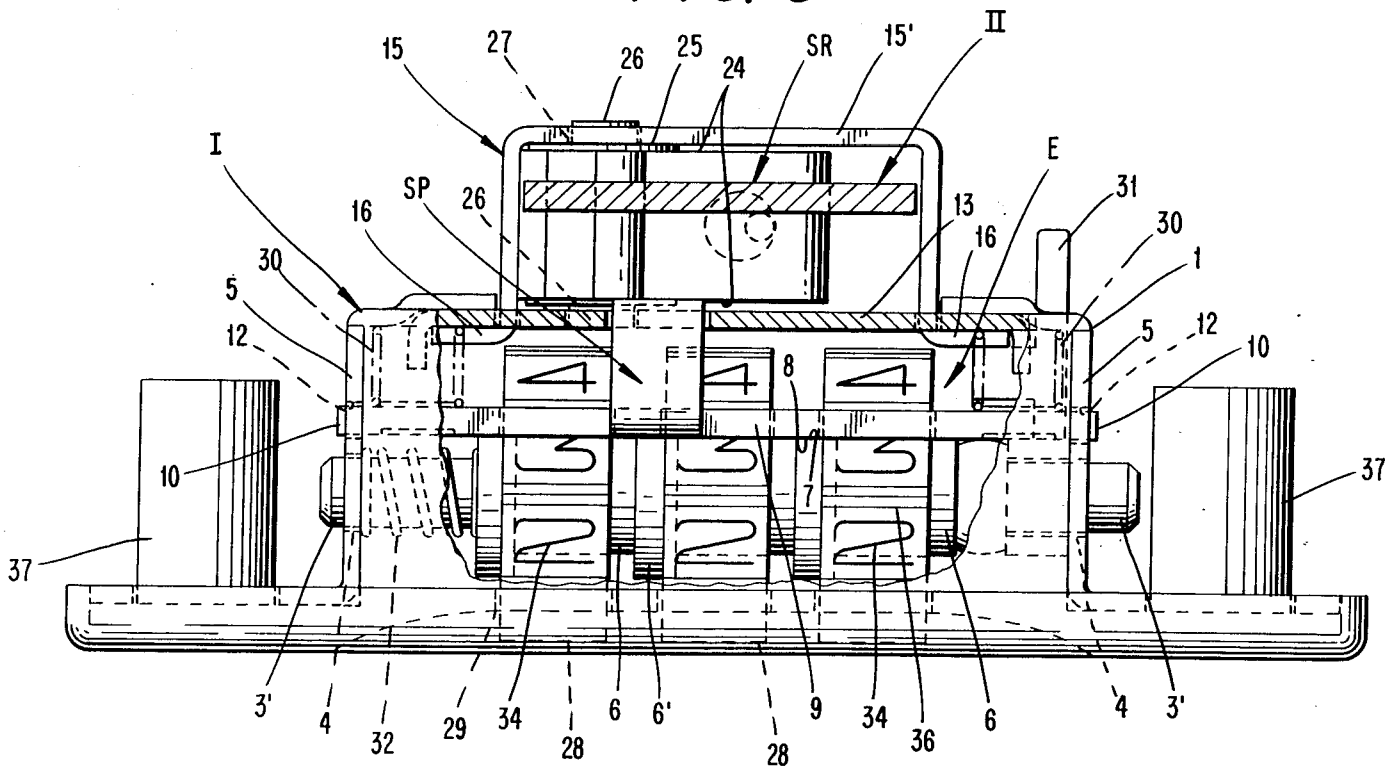
FIG. 3 is a sectional view taken along the line III—III in FIG. 2, with the wall of the suitcase eliminated for clarity.

The permutation lock shown comprises a permutation lock part I and a counter closing part or hasp II. One of these parts I is located on the bottom part a of a suitcase or the like, and the other II on the lid b of this suitcase. The closing joint F is seen in FIG. 2; it has the shape of an S.

The permutation lock is inserted in a window shaped opening O of the wall W of the bottom part of the suitcase.

The permutation lock part I has a box-like lock housing 1. The side of this housing which is open for the insertion of the setting mechanism E is covered by a front plate 2. An axle 3 extends inside the lock housing 1. The latter is located in the longitudinal center plane of the lock housing. The ends 3' of the axle 3 are supported in recesses 4 of end walls 5 of the lock housing 1. The axle 3 is mounted in an axially displaceable manner in the end walls 5 and has the necessary excess length.

The setting mechanism E further comprises locking sleeves 6. The latter are mounted in a row on the axle 3 in contact with each other and are displaceable to a limited extent on that axle 3. Each of the locking sleeves 6 carries at one end a collar 6' which includes a flat 7. In the case of a correctly set code the flat 7 is disposed opposite to the sensing surfaces 8 of a locking element 9. The locking element comprises a ladder-shaped pivoted plate having pivot tabs 10 which are mounted in recesses 12 formed in the end walls 5. The tabs define a pivot axle x.

The locking element 9 extends essentially over the entire internal length of the lock housing 1 and carries on its end opposite the tabs 10 a locking head SP. This head SP comprises a tab angled toward an opening 14 disposed in a rear wall 13 of the lock housing. The opening 14 continues past the corner formed by walls 11, 13 and extends into the side wall 11, in which the locking head SP is partially situated.

It will be appreciated from the foregoing that when the locking element 9 is pivoted to a locking position, the locking head SP will project through the opening 14 and travel toward the hasp II. If the depth y to which the lock housing 1 is immersed within the opening O is sufficient to enable the locking head SP to reach the hasp (such condition not being depicted), the locking head SP is able to cooperate directly with the hasp II to engage the hasp II and hold it in a locked position. In that case, the hasp II could be shaped suitably for mating engagement with the locking head SP, and could be arranged to enter the portion of the slot 14 formed in the wall 11.

If, however, the immersion depth y is so much less than the thickness D of the wall W that the locking head SP cannot reach the hasp II (as depicted in FIG. 2), there will, according to the present invention, be mounted to the housing 1 an attachable/removable ancillary housing 15 in which an intermediate locking member in the form of a pivoted bolt SR is arranged. The bolt SR is located outside the lock housing 1 itself, behind the rear wall 13, and is situated in the ancillary housing 15 which is connected by means of deformable tongues 16 with the rear wall 13. The rear wall 13 contains corresponding insertion slots for the tongues 16 which are then bent.

The pivoted bolt SR is in the form of a forked hook which is spring-loaded in a lock-opening direction. A hooking mouth 17 of the bolt is open in the direction of the approaching hasp II to capture a hook-like projection 18 of the hasp II (see FIG. 5). In this position a hooking head 19 of the pivoted bolt SR has been rotated to the extent that one of its fork legs 19' engages a rear shoulder of the projection 18 in a locking manner. Such rotation was executed against the force of a spring 20, which is also located in the ancillary housing 15. One end of the spring rests against a rear wall 21 of the ancillary housing 15, while the other end of the spring 20 overlaps a centering cone 22 projecting from the other fork leg 19' of the hooking head 19.

In the locking position (FIG. 5) of the lock, the locking head SP overlaps a notched rear flank 23 of the fork leg 19'. That rear flank 23 is located adjacent to the opening 14 in the rear wall 13. One shorter recess flank 23' of the rear flank 23 extends transversely relative to the direction of pivoting motion of the hooking head 19, whereby rotation of the bolt SR to an unlocking position is prevented.

Figure 1:
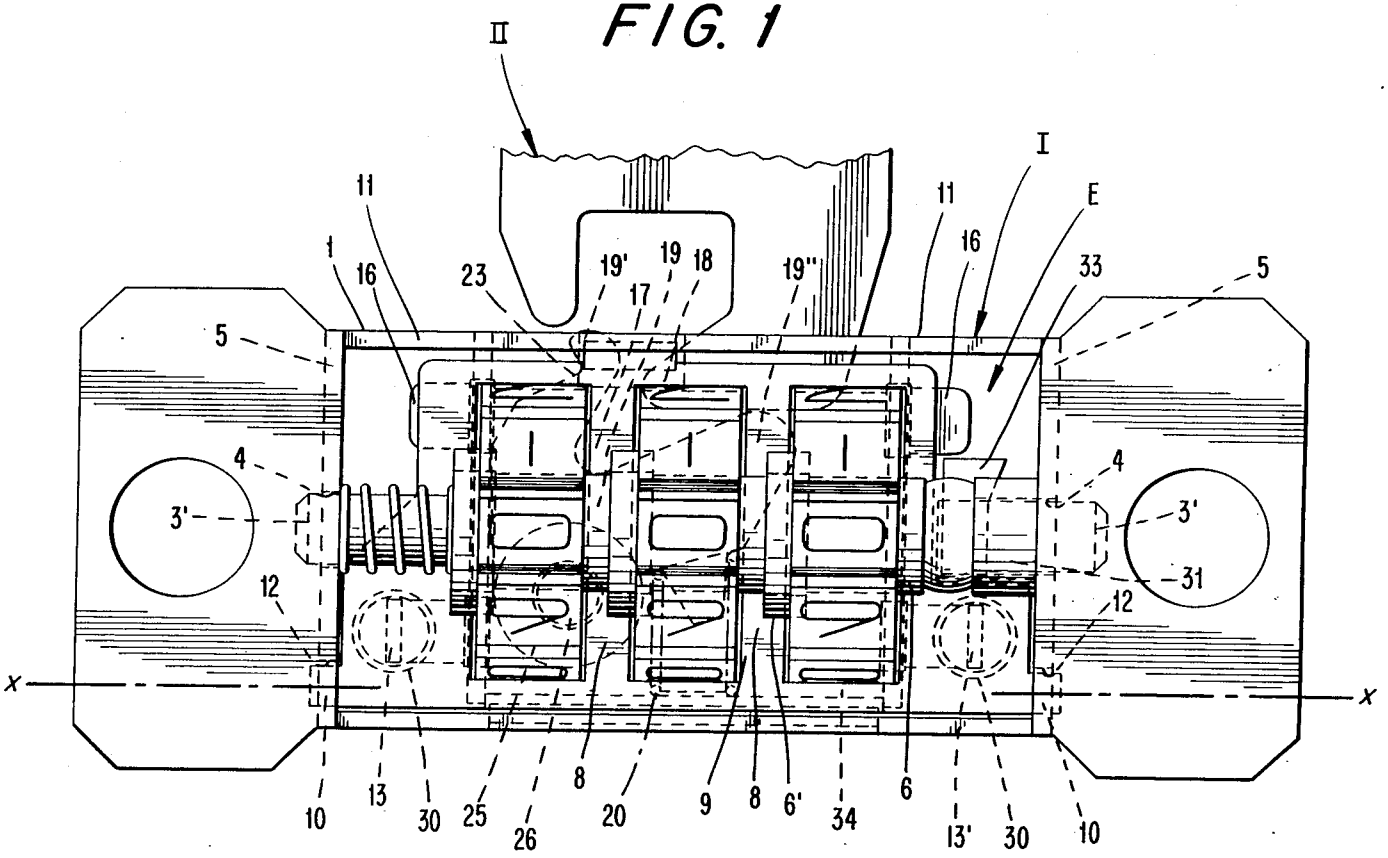
FIG. 1 depicts the permutation lock of the invention in front view, in an unlocked position, with the hasp in the of being inserted.

If, on the other hand, the locking head SP is retracted, by a manipulation to be explained later, the pivoted bolt SR is biased by the spring 20 to an opening position shown in broken lines in FIG. 1. The spring 20 and bolt SR perform an ejecting function in relation to the hasp II by pushing the latter away from the locking position.

As seen further in FIG. 2, the length z of the hooking head 19 corresponds practically to the internal depth of the ancillary housing 15. That length z amounts to approximately one-half of the depth y of the lock housing 1, so that the locking means are clearly in a free position. Since the side of the box-shaped ancillary housing 15 which receives the hasp II is completely open, there exists further an appreciable tolerance range relative to the position of the hasp II with respect to the permutation lock part I.

Lateral surfaces 24 of the bolt SR are partially defined by the ends of a hub 25 which project beyond remaining portions of the lateral surfaces 24. In order to keep the friction generated by the motion of the pivoted bolt as low as possible, only the ends of the hub 25 bear against the outer surface of the bottom wall 13 and a cover 15' of the ancillary housing 15. A pair of axle stubs 26 projects outwardly of the hub and fits into corresponding bearing holes 27 of the cover 15' and the rear wall 13. The stubs 26 form a rotary axle of the pivoted bolt SR. Instead of using the rear wall 13 as the closing wall of the ancillary housing 15, the ancillary housing obviously may also be provided with its own base plate or wall, with the resulting advantage of a complete preassembly of this ancillary part thereby being possible.

The pivoted bolt SR is pivotably supported at its end which is opposite the opening 14, so that the longest length possible of the fork leg 19' may be obtained. The ancillary housing 15 has a width essentially corresponding to that of the lock housing 1. Its length could be fully utilized in case of an appropriate configuration of the hasp (in the present embodiment one-half of the length of the lock housing 1 is sufficient).

The planes in which the pivoted bolt SR and the locking element 9 move are disposed perpendicular to each other. The locking element 9 has, as indicated above, a ladder-like configuration, with the sides of the rungs facing the axle 3 defining the sensing surfaces 8. The latter penetrate windows 29 of the front plate 2 so as to be accessible for manual rotation.

The locking element 9 is loaded by two helical compression springs 30 each having one end retained by a centering projection 13' of the wall 13, and another end bearing against the bottom side of the locking element 9. The latter is thus yieldably held against the collars 6'. of the locking sleeves. Each collar 6' is circular along its outer periphery, except for the flat 7.

An uncoupling of the sleeves 6 from the setting disks 28 for resetting the code is effected by means of an actuating lever 31, which is connected with the axially displaceable axle 3. The uncoupling action takes place against the force of a helical compression spring 32 threaded onto the axle, which spring 32 has one end bearing against a side of the collar of a terminal locking barrel 6, and another end bearing against an end wall 5. The actuating lever may be held in an uncoupling position by being rotated into a bayonet-like side slot 33 formed in the rear wall 13. The setting disks 28 themselves are not displaceable. Following the uncoupling, the setting disks are rotated to set the new combination, which may be observed, for example, by means of the numerical symbols 34 on the circumference of the setting disks.

The prevailing angular positions of the setting disks 28 are yieldably retained by means of locking spring legs 35 whose locking heads enter notch-like locking recesses 36 distributed at 36 degree intervals over the circumference of the setting disks 28.

The lock housing 1 is secured in the opening 0 of the wall W by means of screws or rivets which pass through holding pegs 37 projecting from the rear of the frontal plate 2.

Figure 4:
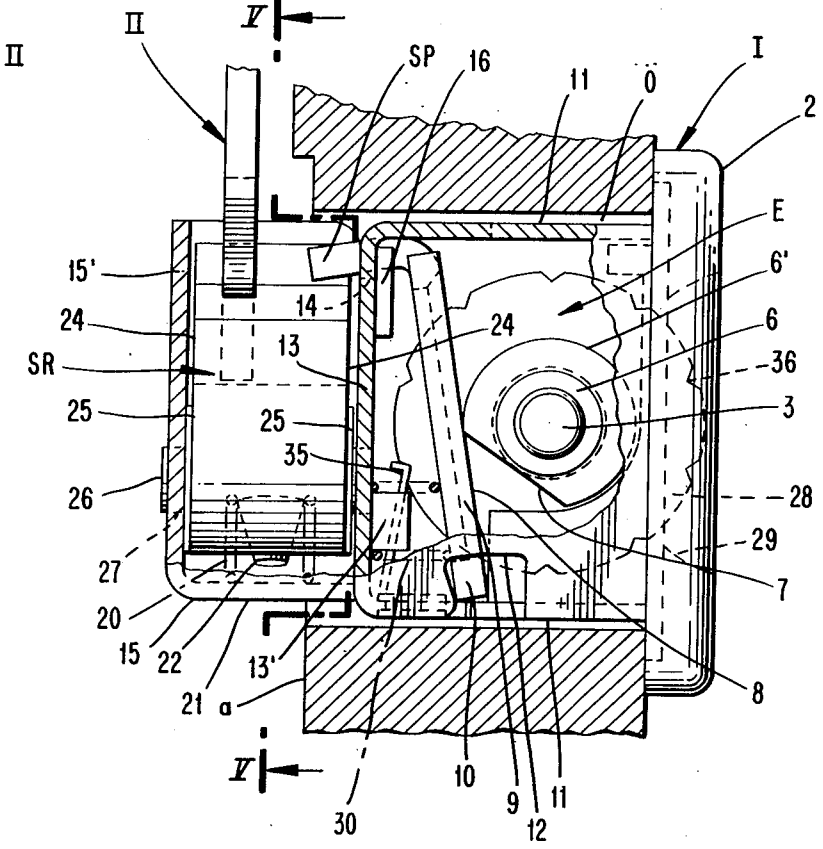
FIG. 4 is a view corresponding to FIG. 2, but in the locking position.
Figure 5:
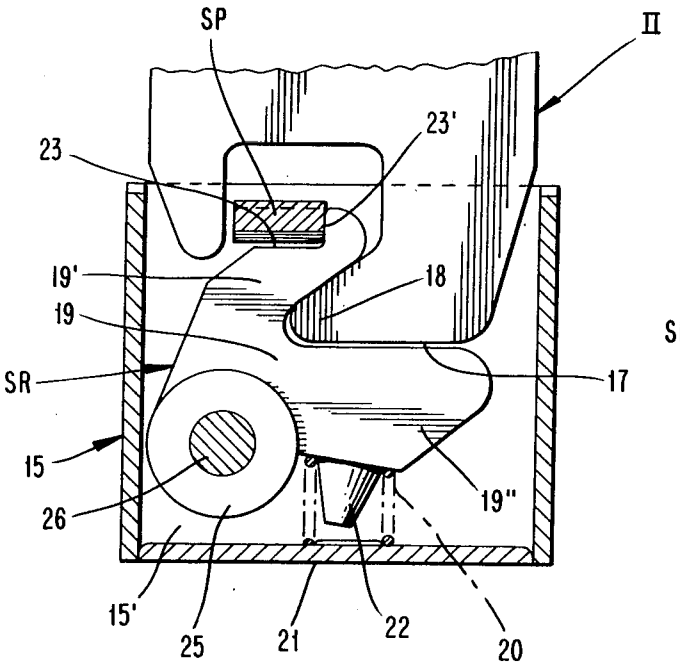
FIG. 5 is a sectional view taken along the line V—V in FIG. 4.

IN OPERATION, when the lock is open (FIG. 2), the locking element 9 is in the release position, i.e., its sensing surfaces 8 engage the flats 7 of the collar 6'. In this position, the pivoting bolt SR is pivoted against the force of the spring 20 in response to the insertion of the hasp II into the ancillary housing 15. By then rotating one of the setting disks 28 by at least, one switching step, the edge of the flat pivots the closing element 9 against the force of springs 30, so that the locking head SP moves through the opening 14 to a position behind the surface 23' to prevent rotation of the bolt SR and thus define the locking position (FIGS. 4, 5).

If the case is to be opened, it is merely necessary to reset the presently valid code. The locking element 9 then pivots back under a spring load into its base position according to FIG. 2. The hasp II is then ejected from its locking position by the bolt SR under the urging of the spring 20.

Although the present invention has been described in connection with a preferred embodiment of the invention, it will be appreciated by those skilled in the art that additions, modifications, substitutions, and deletions not specifically described may be made without departing from the spirit and scope of the invention as defined in the appended claims.

What is claimed is:

1. In a permutation lock adapted to secure a hasp, said lock comprising a main housing having a front plate with a plurality of windows, a permutation setting mechanism including manually actuable setting elements protruding through the windows, a plurality of rotary members operably connected to said setting elements, said rotary members each including an interruption on its outer periphery, a movable spring-biased locking element engageable with said rotary members in such manner that said locking element is situated in a locking position if any of said setting elements is off-combination and in an unlocking position if all of said setting elements are on-combination, a movable spring-biased locking bolt arranged for rotation between a locking position for securing the hasp and an unlocking position for releasing the hasp, said locking element when in its locking position preventing said bolt from moving from its locking position to its unlocking position, an ancillary housing connected to said main housing at a rear end thereof opposite said front plate, said bolt and its biasing spring being mounted in said ancillary housing, one of said main and ancillary housings including a wall between said locking bolt and said locking element, said locking element including a lock portion arranged to project through an opening defined by a region not covered by said wall, when said locking element is in its locking position, in order to prevent rotation of said bolt from its locking position to its unlocking position.

2. A lock according to claim 1, wherein said locking bolt is pivotably mounted in said ancillary housing.

3. A lock according to claim 1, wherein said ancillary housing includes a completely open side arranged to face the hasp.

4. A lock according to claim 3, wherein said open side defines a depth of said ancillary housing, the thickness of said bolt corresponding to said depth.

5. A lock according to claim 1 including releasable fastening means for securing said ancillary and main housings together.

6. A lock according to claim 5, wherein said fastening means comprises bendable tabs on one of said housings.

7. A lock according to claim 6, wherein said tabs are on said ancillary housing and are receivable in holes formed in said main housing.

8. A lock according to claim 1, wherein said wall forms part of said main housing.

9. A lock according to claim 1, wherein said opening is formed in said wall.

10. A lock according to claim 1, wherein said bolt includes a surface, said lock portion of said locking element comprising a projection movable into the travel path of said surface when said locking element is in its locking position.

11. A lock according to claim 1, wherein said ancillary housing includes a partially open side arranged to face the hasp.

* * * * *